US005755525A

United States Patent [19]

Chan

[11] Patent Number: 5,755,525

[45] Date of Patent: May 26, 1998

[54] RING BINDER

[75] Inventor: Keung Chan, An Hsin, China

[73] Assignee: Leco Stationary Manufacturing Company Limited, Kwai Chung, Hong Kong

[21] Appl. No.: 725,054

[22] Filed: Oct. 2, 1996

[30] Foreign Application Priority Data

May 21, 1996 [EP] European Pat. Off. ..... 96303636

[51] Int. Cl.[6] ..... B42D 3/00

[52] U.S. Cl. ..... 402/36; 402/29; 402/31

[58] Field of Search ..... 402/31, 33, 36–43, 402/26, 49, 29

[56] References Cited

U.S. PATENT DOCUMENTS

| | | | |
|---|---|---|---|
| 2,158,056 | 5/1939 | Cruzan | 402/38 |
| 4,566,817 | 1/1986 | Barrett et al. | 402/38 |
| 5,346,325 | 9/1994 | Yamanoi . | |

FOREIGN PATENT DOCUMENTS

| | | | |
|---|---|---|---|
| A 31 19 779 | 9/1982 | Germany . | |
| 270400 | 10/1983 | Taiwan . | |
| 175227 | 2/1922 | United Kingdom | 402/39 |
| A 2254828 | 10/1992 | United Kingdom . | |

*Primary Examiner*—A. L. Pitts
*Assistant Examiner*—Gregory Andoll
*Attorney, Agent, or Firm*—Pollock, Vande Sande & Priddy

[57] ABSTRACT

A ring binder comprising a substantially rigid upper structure, a lower structure supported by the upper structure and at least two pairs of ring members mounted to the lower structure, the at least two pairs of ring members comprising a first type of ring member and a second type of ring member and the lower structure being pivotally movable between a first position in which the at least two pairs of ring members are closed and locked, and a second position in which the at least two pairs of ring members are open and unlocked, wherein when a force is applied to the first type of ring member of the at least two pairs of ring members, the ring binder is unlocked and the lower structure is movable from the first position to the second position in order to open all the pairs of ring members, and wherein when a force is applied to the second type of ring member of the at least two pairs of ring members, the lower structure is locked against movement from the first position to the second position.

24 Claims, 16 Drawing Sheets

RING BINDER

BACKGROUND OF THE INVENTION

This invention relates to a ring binder and, in particular, a ring binder including a substantially rigid upper structure supporting a pivotable lower structure, to which a number of pairs of rings are mounted.

Existing ring binders include different kinds of locking mechanisms for preventing accidental opening of the pairs of rings, thus allowing paper to fall off the binders. In the absence of a locking mechanism, if the ring binder is in a vertical position, the paper may force the pairs of rings to open, thus trapping one or more sheets of paper therebetween. In addition, if there is no proper locking mechanism, in case the ring binder is turned over when holding a large amount of paper, the paper may, by virtue of its weight, force the pairs of rings to open.

There are existing ring binders including at either end thereof a lever which is operable to pivot the lower plates to selectively open and/or close pairs of ring members mounted on the plates. Such levers are movable among a first position in which the pairs of ring members are closed and are locked against any force applied thereon, a second position in which the pairs of ring members are closed but may be opened by force applied on any of the pairs of ring members, and a third position in which the pairs of ring members are open.

SUMMARY OF THE INVENTION

According to the present invention, there is provided a ring binder comprising a substantially rigid upper structure supporting a lower structure to which at least two pairs of ring members are mounted, the lower structure being pivotally movable between a first position in which the pairs of ring members are closed and locked, and a second position in which the pairs of ring members are open and unlocked, wherein when force is applied on at least one pair of ring members, the ring binder is unlocked and the lower structure is movable from the first position to the second position in order to open all the pairs of ring members, and in that when force is applied on at least one other pair of ring members, the lower structure is locked against movement from the first position to the second position.

When force is applied on any of the pair of ring members, the ring binder may suitably be movable from the second position to the first position in order to close and lock the pairs of rings.

Advantageously, the binder may comprise lock means movable between a locked position in which the lower structure is locked against movement from the first position to the second position, and an unlocked position in which the lower structure is movable from the first position to the second position.

Conveniently, the lock means may comprise at least one lock member which, when the lock means is in its locked position, engages the lower structure against pivotal movement.

Suitably, the lock means may comprises two lock members.

The lock member(s), in its locked position, may advantageously engage an upper surface of the lower structure.

The lower structure may conveniently comprises stopping means against which the lock member(s) engages when the lock means is in its locked position.

The lower structure may suitably comprise aperture means for receiving at least part of the lock member(s) when the lower structure moves from its first position to its second position.

Advantageously, the lock means may comprise a key member operable to move the lock means from the locked position to the unlocked position.

Conveniently, the key member may be operable to disengage the lock member(s) from the lower structure.

Suitably, the key member may be operable to disengage the lock member(s) from the upper surface of the lower structure.

The key member may advantageously be operable to disengage the lock member(s) from the stopping means.

The key member may conveniently be fixedly engaged with the lock member(s) for simultaneous movement.

The key member may suitably comprise a sloped portion upon which the lower structure acts when the lower structure moves from its first position to its second position.

Advantageously, when the sloped position of the key member is acted upon by the lower structure, the lock member(s) may be movable from its locked position to its unlocked position.

Conveniently, the lower structure may comprise hole means for receiving at least part of the key member when the lower structure moves from its first position to its second position.

Suitably, the key member may comprise a wire element.

The lock means may advantageously be engaged with the upper structure.

The lock means may conveniently be swivellably movable relative the upper structure.

The lock means may suitably be supported for swivelling movement by support means.

Advantageously, the support means may comprise at least one inturned part of the upper structure.

Conveniently, the key member may be adjacent the pair of operable ring members.

Suitably, the binder may comprise securing means adapted to secure the ring binder to an base member.

The securing means may advantageously be integrally formed with the upper structure.

BRIEF DESCRIPTION OF THE DRAWINGS

The invention will now be described, by way of examples only, with reference to the accompanying drawings, wherein.

DETAILED DESCRIPTION OF PREFERRED EMBODIMENTS

As shown in FIGS. 1 to 8B, a ring binder according to a first embodiment of the present invention is generally designated as 10. The ring binder 10 includes an upper casing 12 supporting a pair of plates 14*a* and 14*b* to which three pairs of half rings 16*a*, 16*b* and 16*c* are mounted. The plates 14*a* and 14*b* are pivotally movable relative to each other, so that the pairs of half rings 16*a*, 16*b* and 16*c* may be selectively opened or closed. The half rings 16*a*, 16*b* and 16*c* extend through three pairs of slots 18*a*, 18*b* and 18*c* on the upper casing 12, which allow the halfs rings 16*a*, 16*b* and 16*c* to open or close. At each end of the ring binder 10 is a hole 20*a* and 20*b*, through which a rivet (not shown) may be received to secure the ring binder 10 to an article (not shown), e.g. a paperboard/plastic/metal cover.

Figure 1:
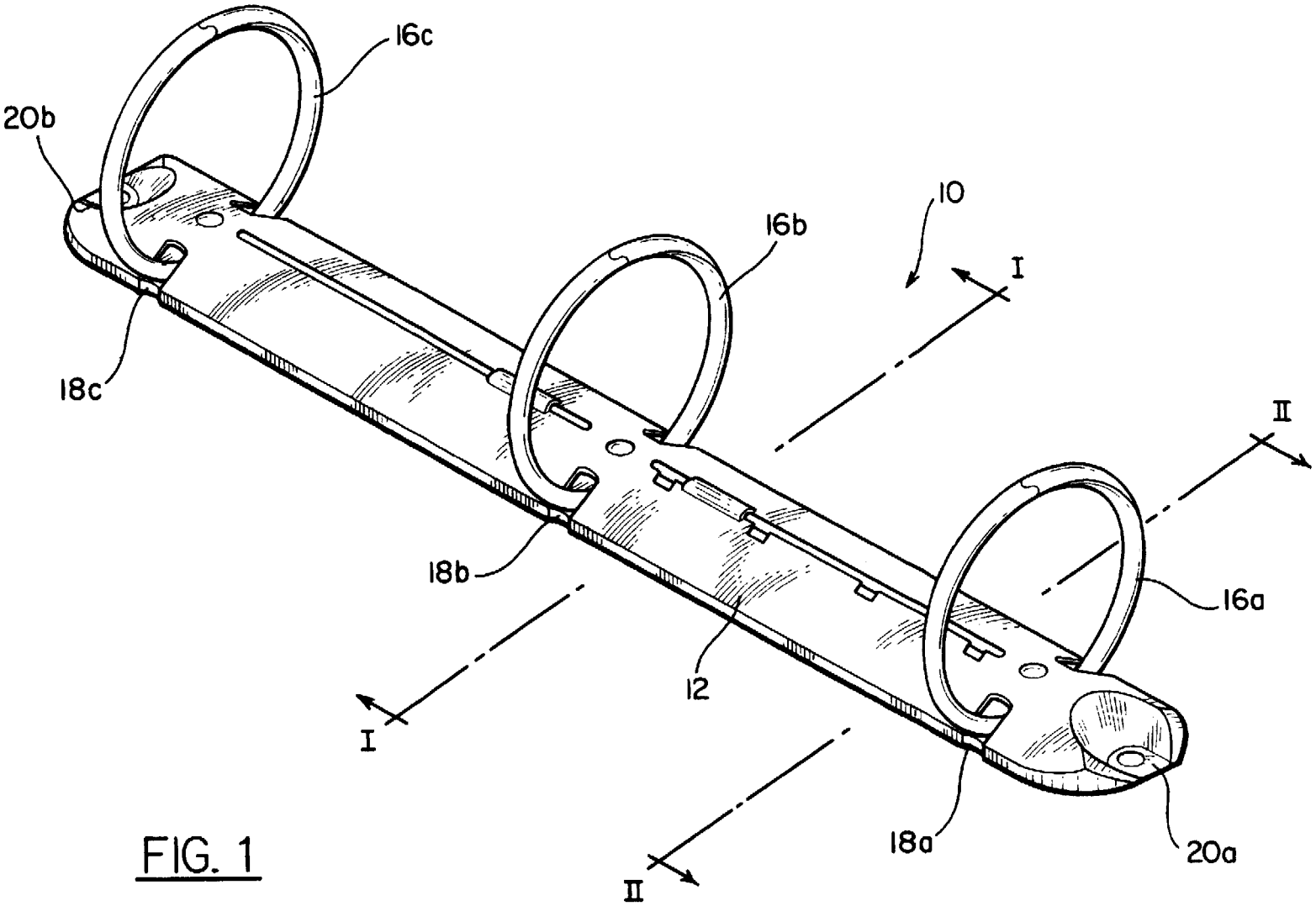
FIG. 1 shows a top perspective view of a first embodiment of a ring binder according to the present invention with the rings in a closed position.
Figure 2:
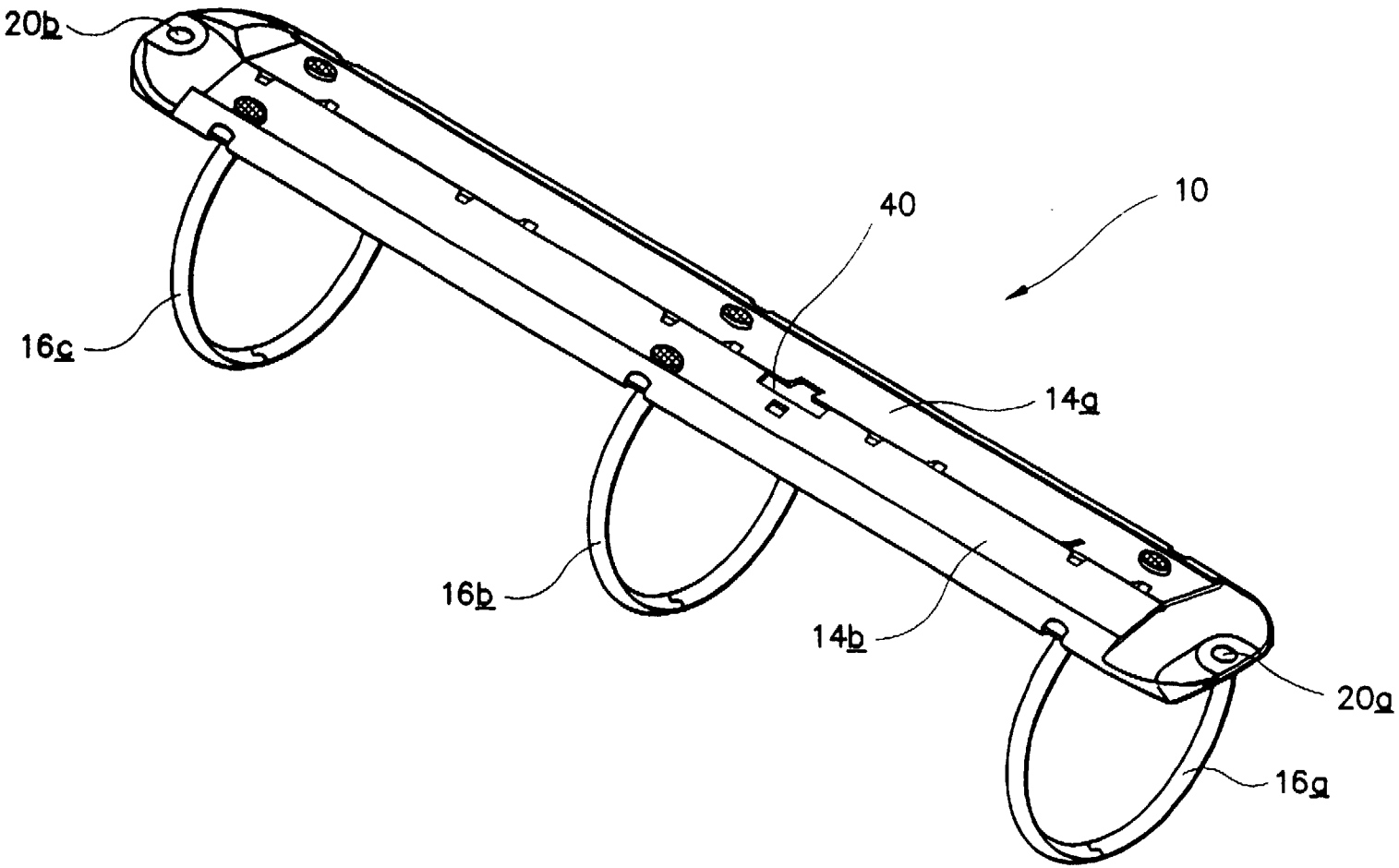
FIG. 2 shows a bottom perspective view of the ring binder shown in FIG. 1.
Figure 3:
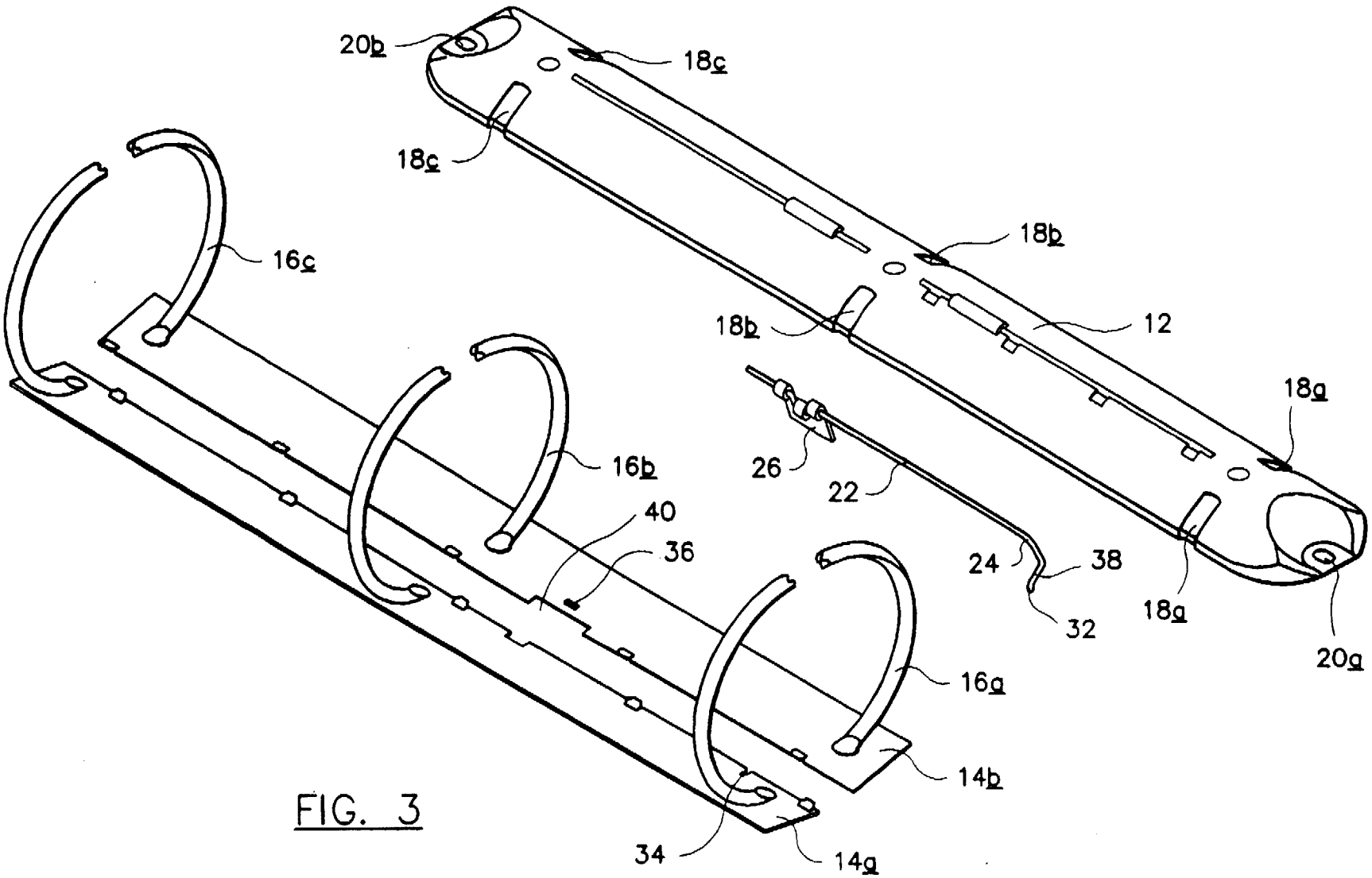
FIG. 3 shows an exploded view of the ring binder shown in FIG. 1.
Figure 4:
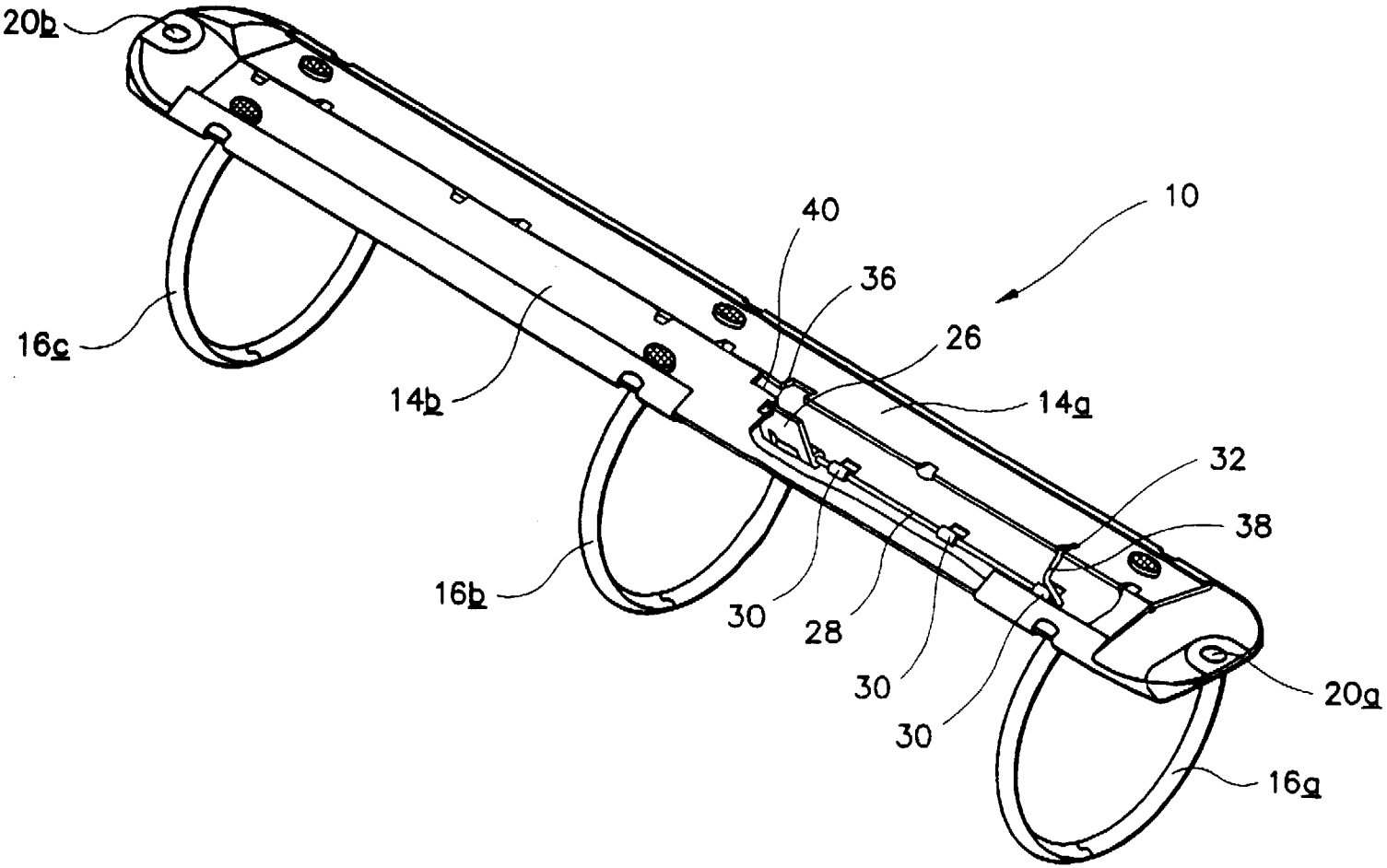
FIG. 4 shows a bottom perspective view of the ring binder shown in FIG. 1, with part of the lower structure removed for clarity purposes.
Figure 5:
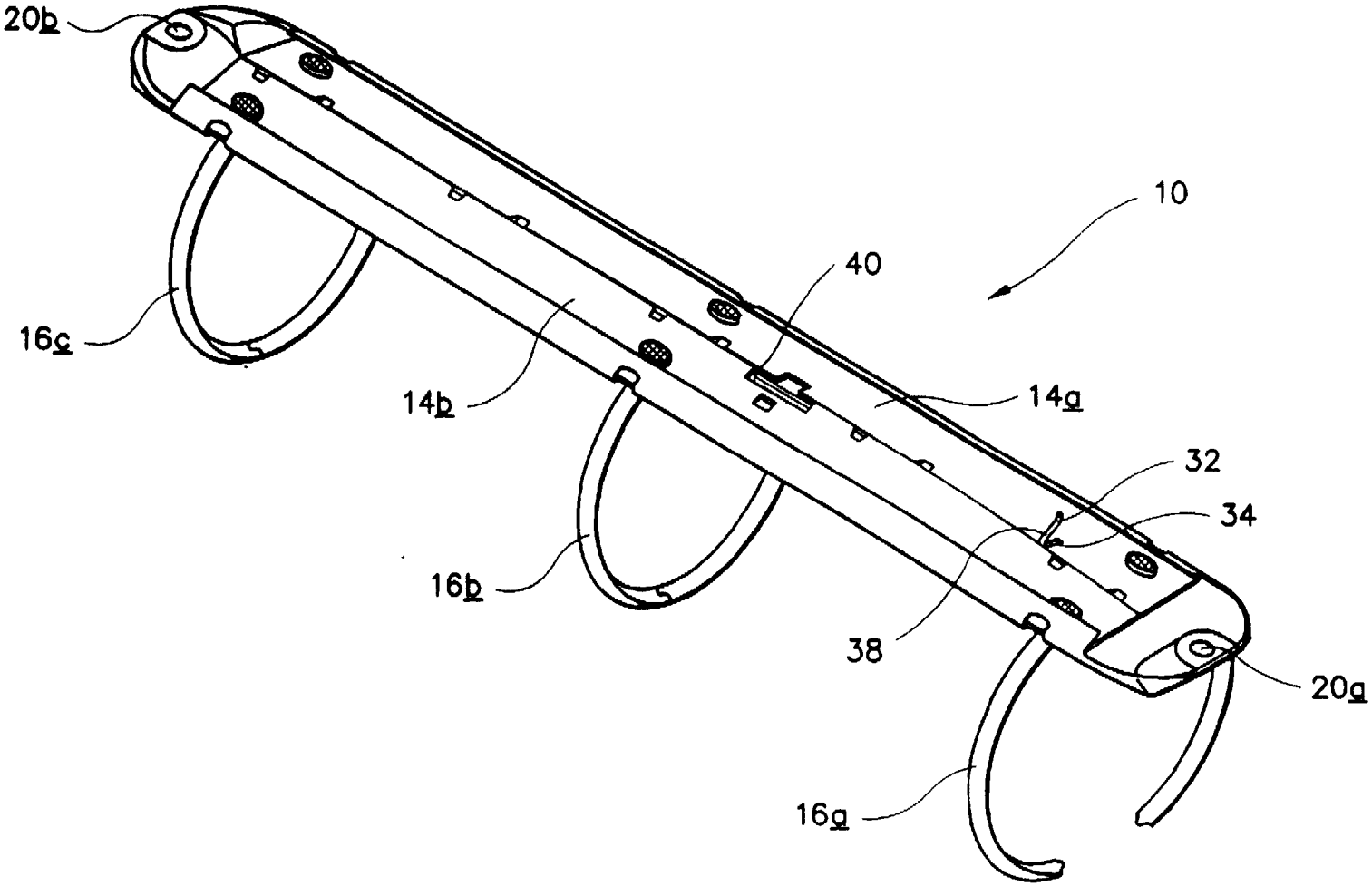
FIG. 5 shows the ring binder of FIG. 1 with its lower structure in a partly moved position.
Figure 6:
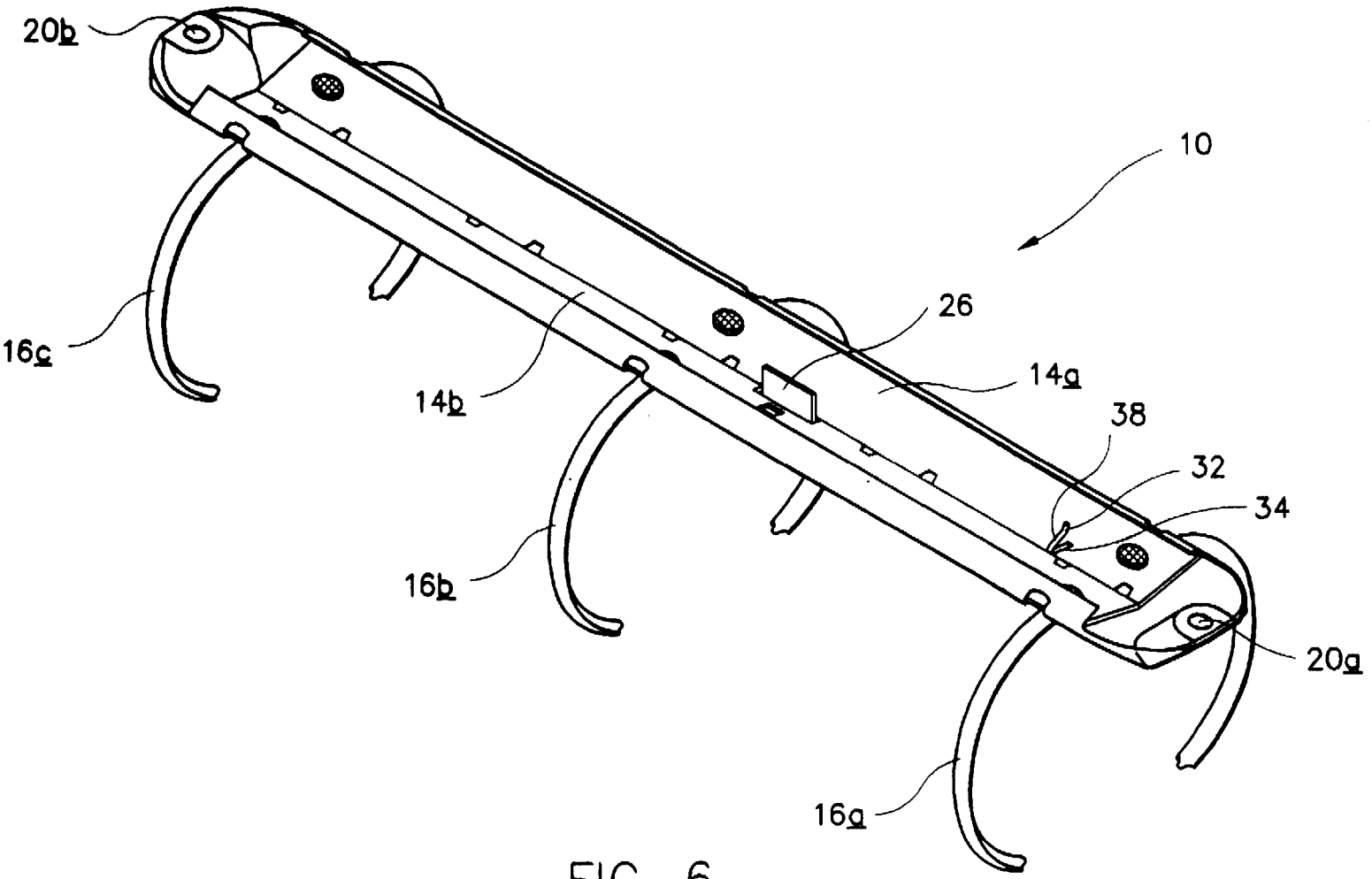
FIG. 6 shows the ring binder of FIG. 1 with the rings in an open position.
Figure 7B:
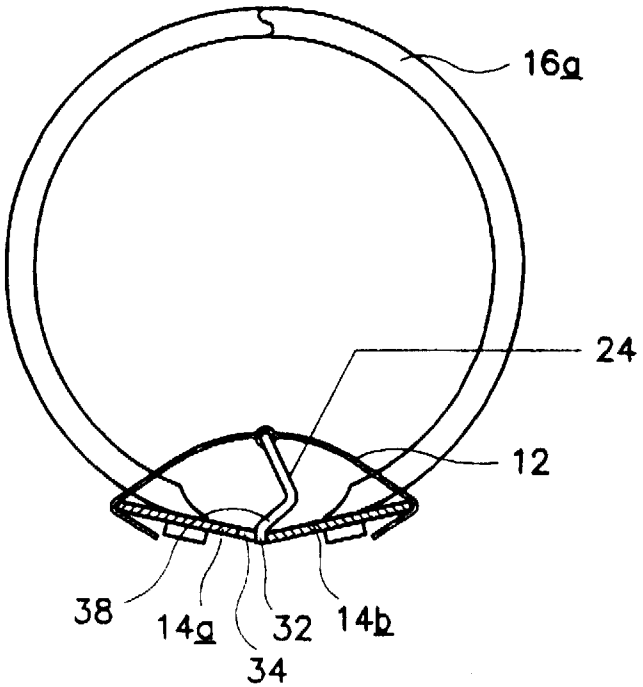
FIG. 7B shows a transverse sectional view of the ring binder shown in FIG. 1 taken at section line II—II across the key member with the rings in the closed position.
Figure 7A:
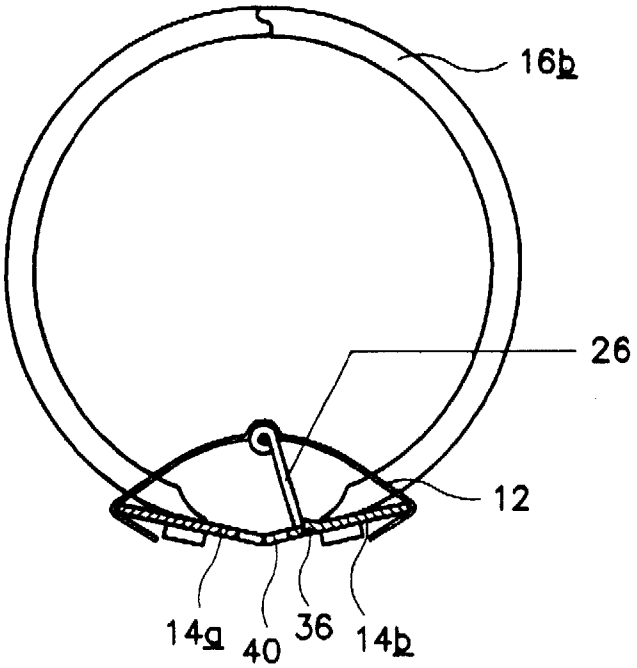
FIG. 7A shows a transverse sectional view of the ring binder shown in FIG. 1 taken at section line II across the lock member with the rings in the closed position.
Figure 8B:
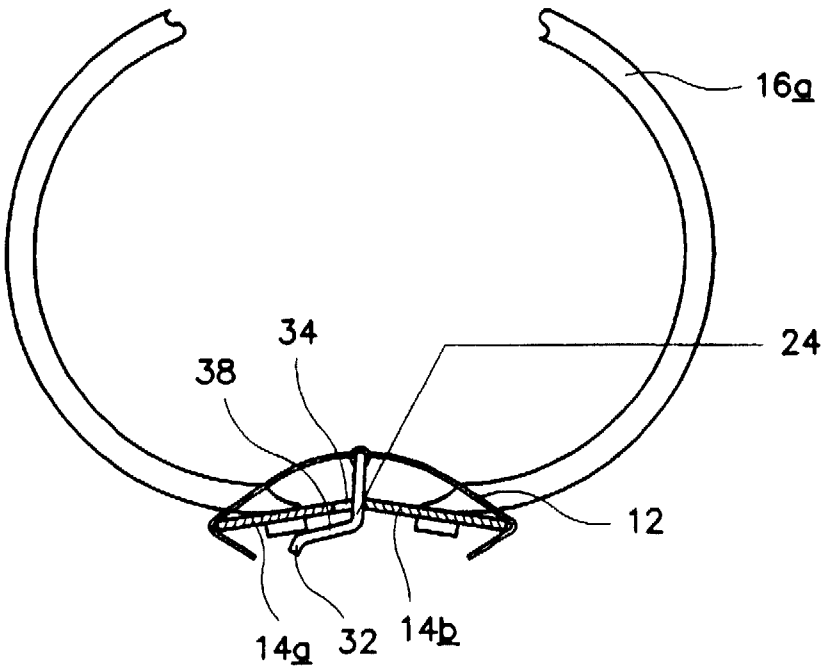
FIG. 8B shows a transverse sectional view of the ring binder shown in FIG. 1 taken at section line II—II across the key member with the rings in the open position.
Figure 8A:
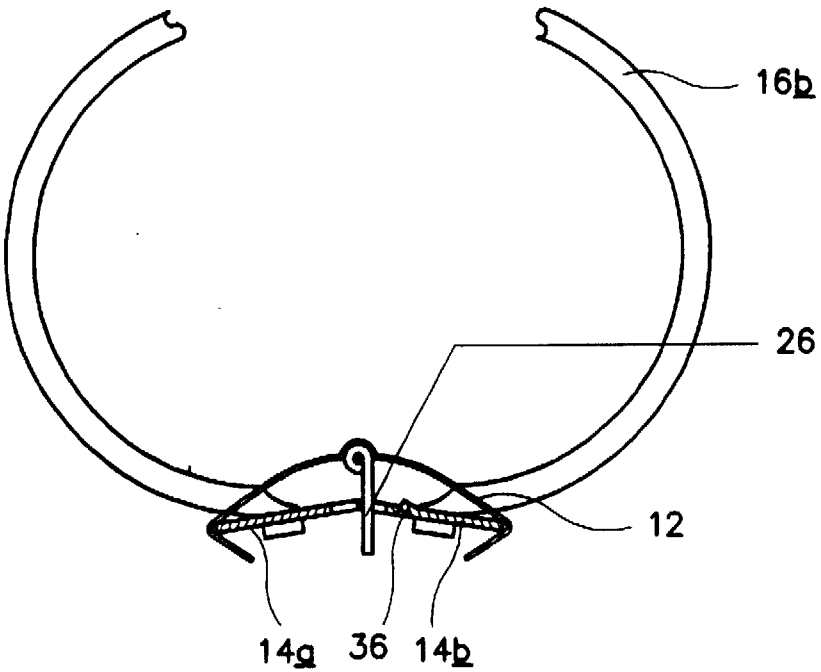
FIG. 8A shows a transverse sectional view of the ring binder shown in FIG. 1 taken at section line I—I across the lock member with the rings in the open position.
Figure 9:
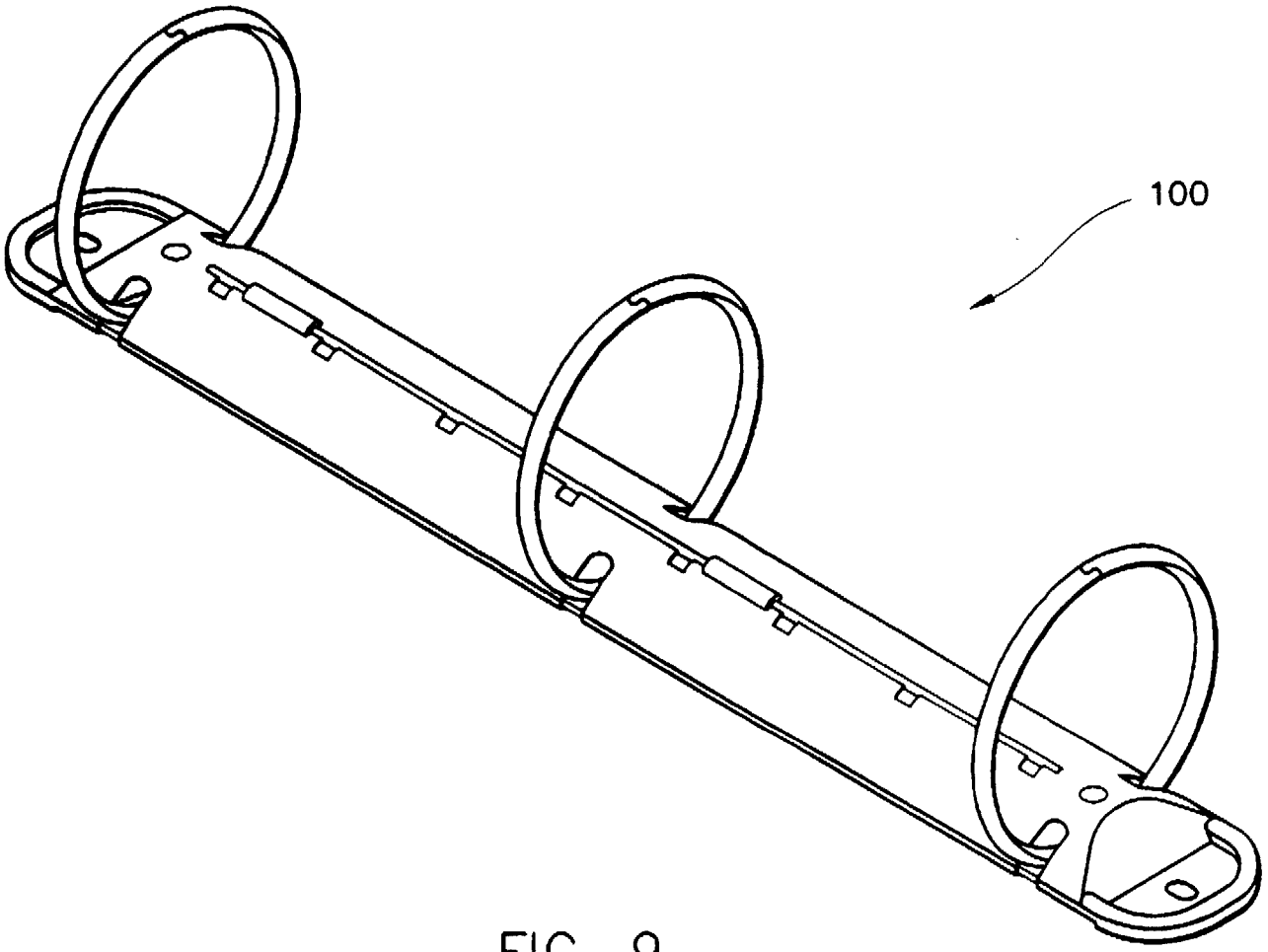
FIG. 9 shows a top perspective view of a second embodiment of a ring binder according to the present invention with the rings in a closed position.
Figure 10:
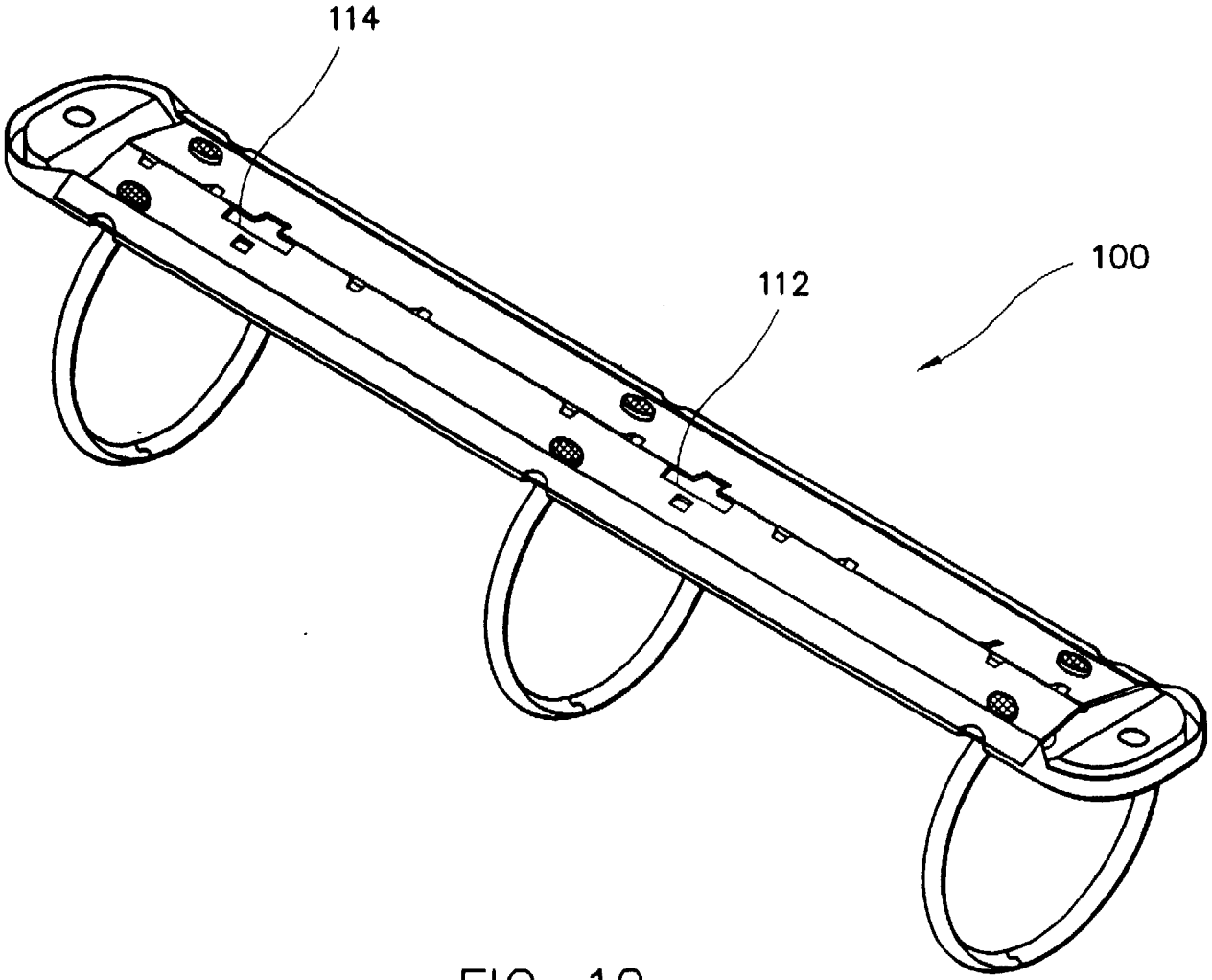
FIG. 10 shows a bottom perspective view of the ring binder shown in FIG. 9.
Figure 11:
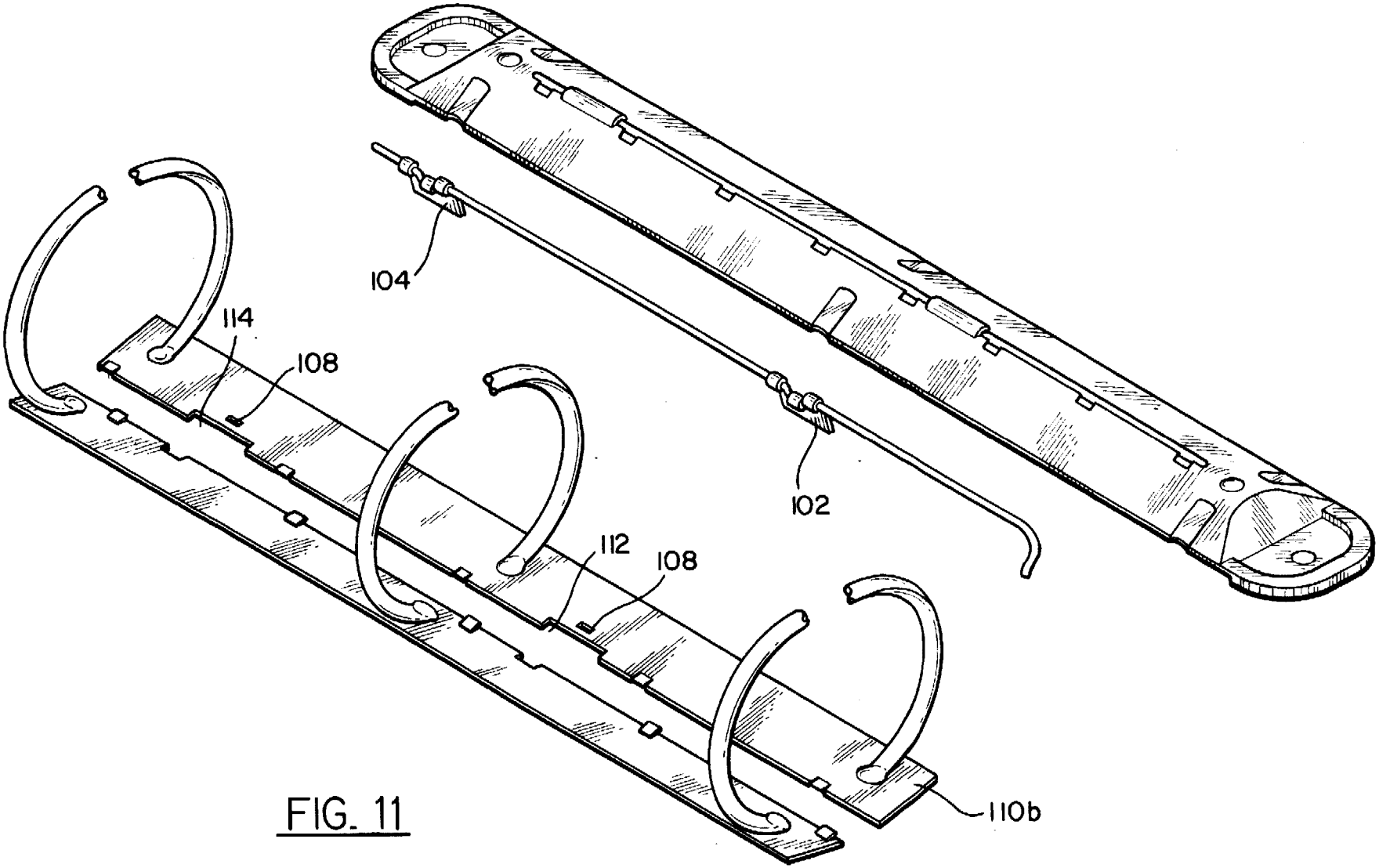
FIG. 11 shows an exploded view of the ring binder shown in FIG. 9.
Figure 12:
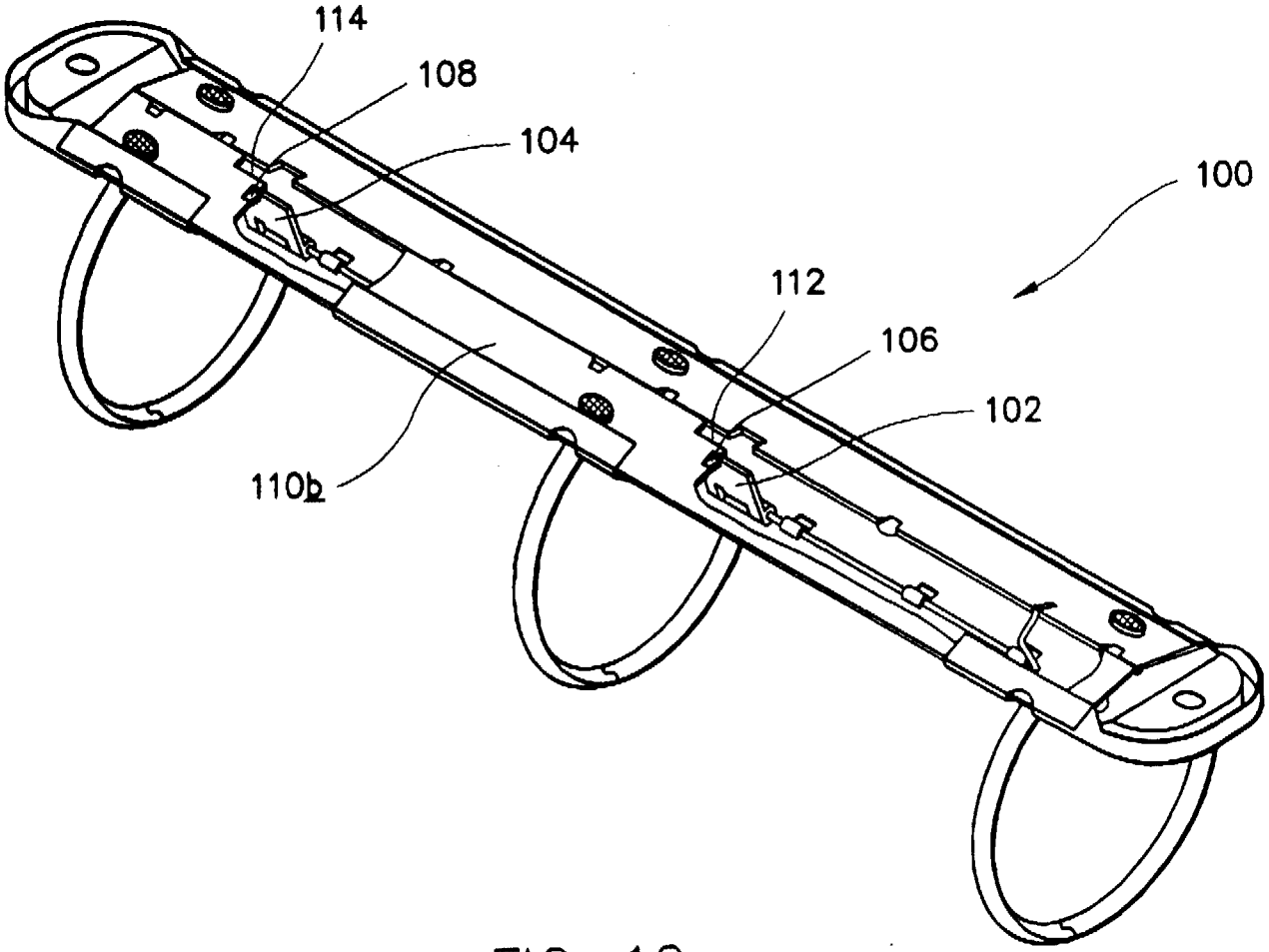
FIG. 12 shows a bottom perspective view of the ring binder shown in FIG. 9, with part of the lower structure removed for clarity purposes.
Figure 13:
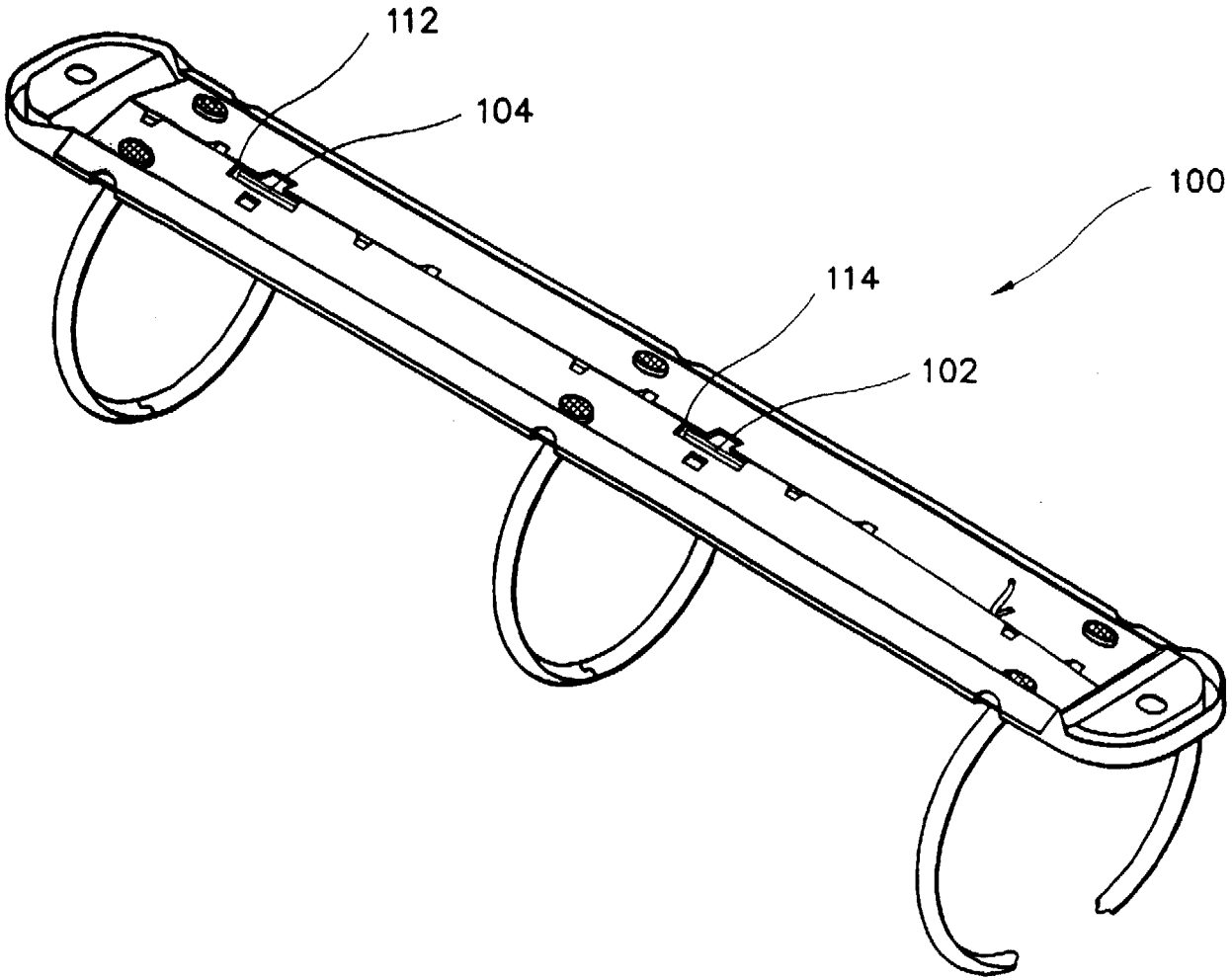
FIG. 13 shows the ring binder of FIG. 9 with its lower structure in a partly moved position.
Figure 14:
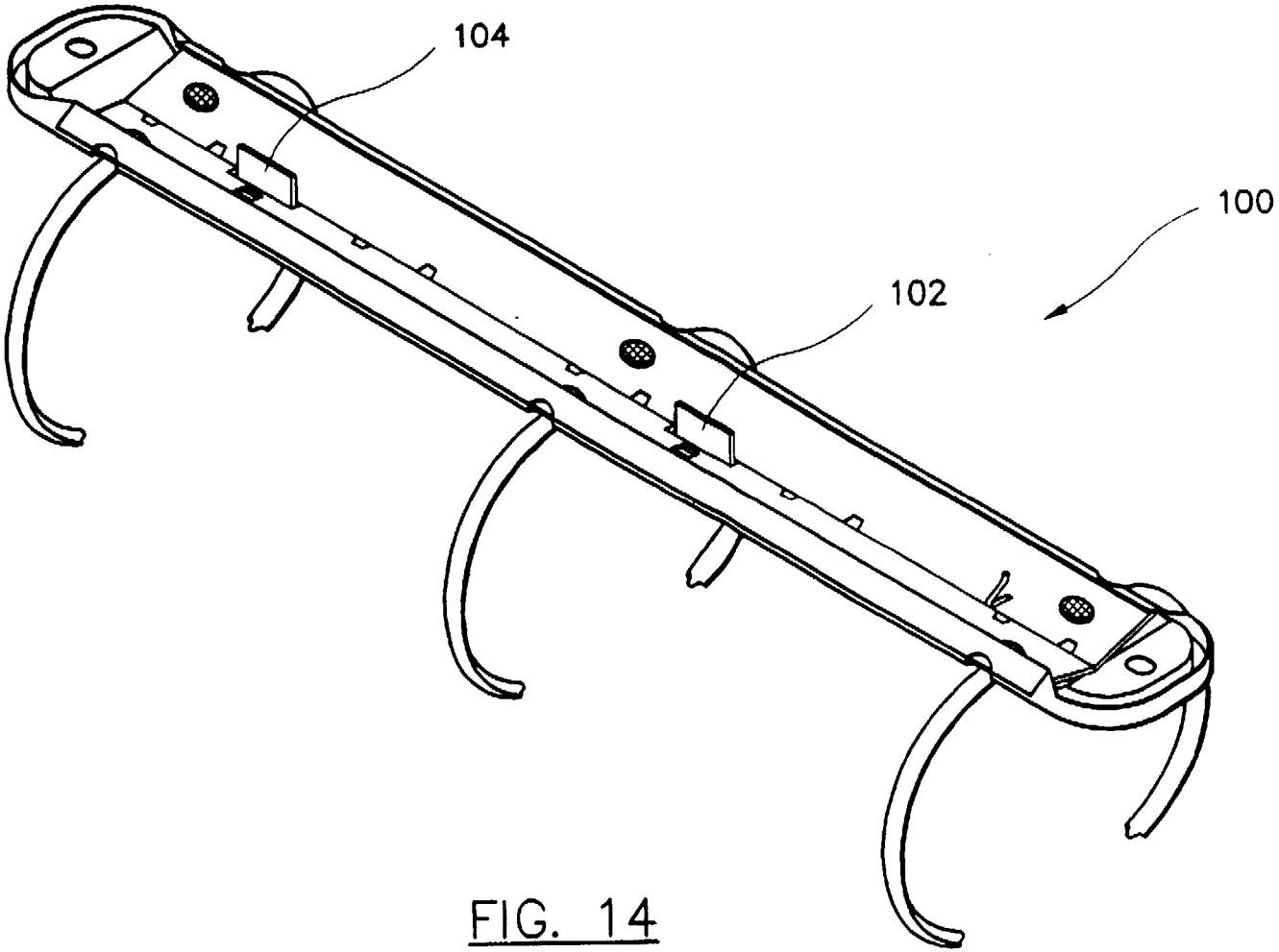
FIG. 14 shows the ring binder of FIG. 9 with the rings in an open position.

As shown more clearly in FIG. 3, the ring binder 10 includes a lock 22 including a wire 24 with a lock element 26 fixedly crimped thereon. As shown in FIG. 4, the wire 24 includes a shaft 28 which is secured to the lower surface of the upper casing 12 by three inturned parts 30 crimped therewith. The lock 22, the wire 24 and the lock element 26 are thus allowed to swivel about the longitudinal axis of the shaft 28.

In the position when all the rings 16*a*, 16*b* and 16*c* are closed, as shown in FIG. 1, 2, 4, 7A and 7B, a distal end 32 of the wire 24 extends slightly through an aperture 34 of the plate 14*a*. In this position, the lock element 26 abuts against both the upper surface of the plate 14*b* and a tongue 36. In this position, any attempt to open the half rings 16*a*, 16*b* and 16*c* by applying force to half rings 16*b* or 16*c* will not be successful as the plate 14*b*, and consequently the plate 14*a*, is prevented from exhibiting any upward pivoting movement by reason of the lock element 26 acting against the plate 14*b*.

On the other hand, if a pulling force is applied on the half rings 16*a*, the plate 14*b* will act upon a bent portion 38 of the wire 24 from below. This will cause the lock 22 to rotate about the shaft 28 in a clockwise direction (according to FIG. 7A) to the position shown in FIG. 5. In this position, the wire 24 extends further through the aperture 34 of the plate 14*a*, and the lock element 26 is moved away from the upper surface of the plate 14*b* and the tongue 36, and aligns with an opening 40 of the plate 14*b*. Further pivoting movement of the plates 14*a* and 14*b*, and thus opening of all the half rings 16*a*, 16*b* and 16*c* , are thus made possible by further pulling action on the half rings 16*a*.

The half rings 16*a*, 16*b* and 16*c* may be returned to the closed position by pushing together any one of the three pairs of half rings 16*a*, 16*b* and 16*c*. When a pushing force is applied on any of the three pairs of half rings 16*a*, 16*b* and 16*c*, the plate 14*a* will act from above on the bent portion 38 of the wire 24, so that the lock 22 is caused to rotate about the shaft 28 in an anti-clockwise direction (according to FIG. 8B) to the position shown in FIG. 7B.

The extent of return movement of the lock element 26 to its locked position is governed by the tongue 36, which prevents excessive movement of the lock element 26. This also prevents the distal end 32 of the wire 24 from being hidden in the cavity formed by the upper casing 12 and the plates 14*a* and 14*b*.

It is clear from the foregoing discussion that, in the present invention, only one pair of half rings, namely 16*a*, can be actioned upon to cause the plates 14*a* and 14*b* to pivot, and thereby to open all the half rings 16*a*, 16*b* and 16*c*. The ring binder 10 is thus locked from any opening movement unless this specific pair of half rings are actioned upon. On the other hand, all the half rings 16*a*, 16*b* and 16*c* can be actioned upon to close the binder.

FIGS. 9 to 14 show a second embodiment of a ring binder according to the present invention generally designated as 100. The major difference of this embodiment from the first embodiment discussed above is the provision of two lock elements 102 and 104. Consequently, two tongues 106 and 108 are provided on the upper surface of a plate 110*b* to govern the movements of the lock elements 102 and 104 back to the locked position, and two openings 112 and 114 are provided on the plate 110*b* for allowing part of the lock elements 102 and 104 to pass through.

Figure 15:
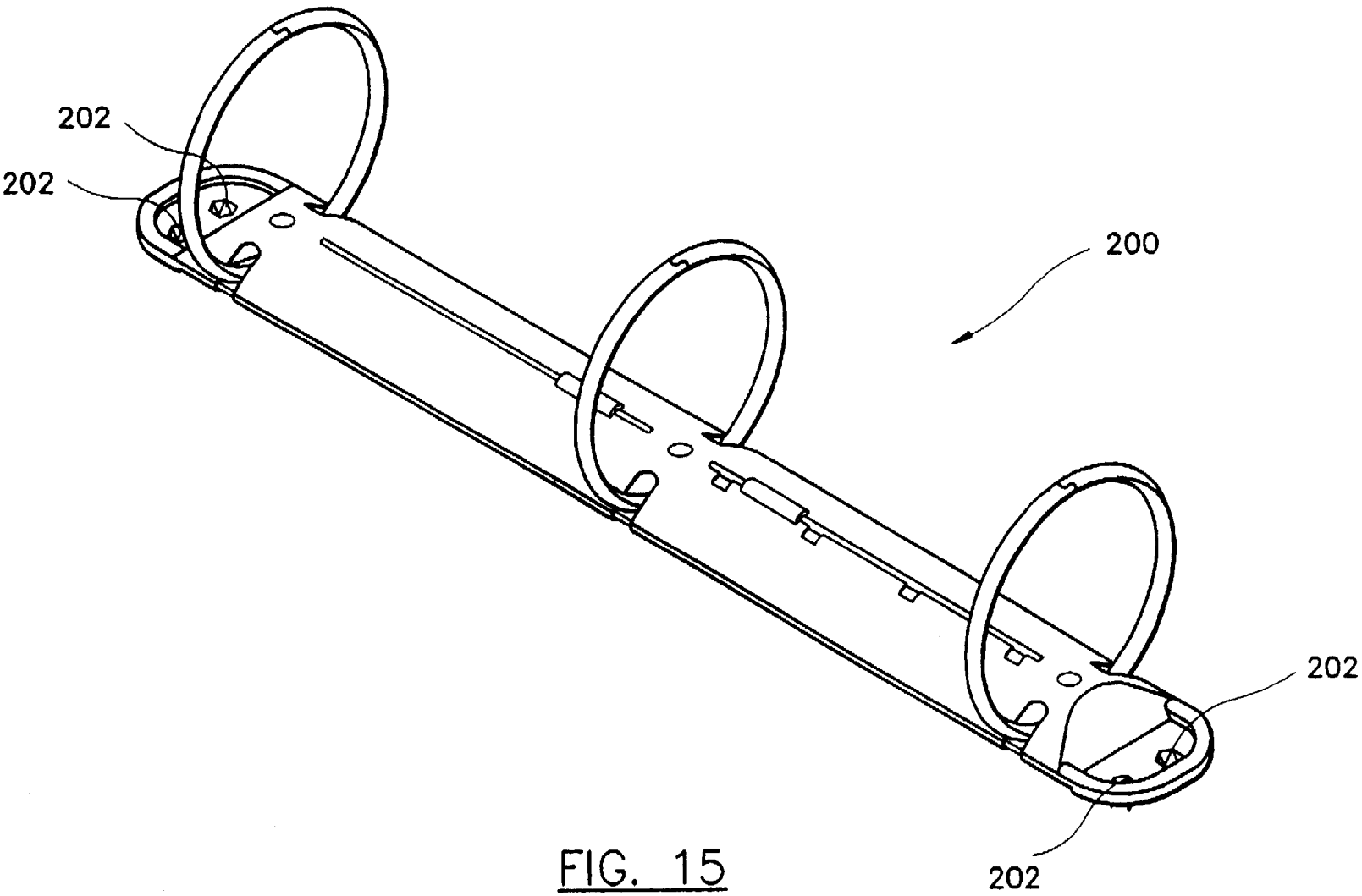
FIG. 15 shows a top perspective view of a third embodiment of a ring binder according to the present invention with the rings in a closed position.
Figure 16:
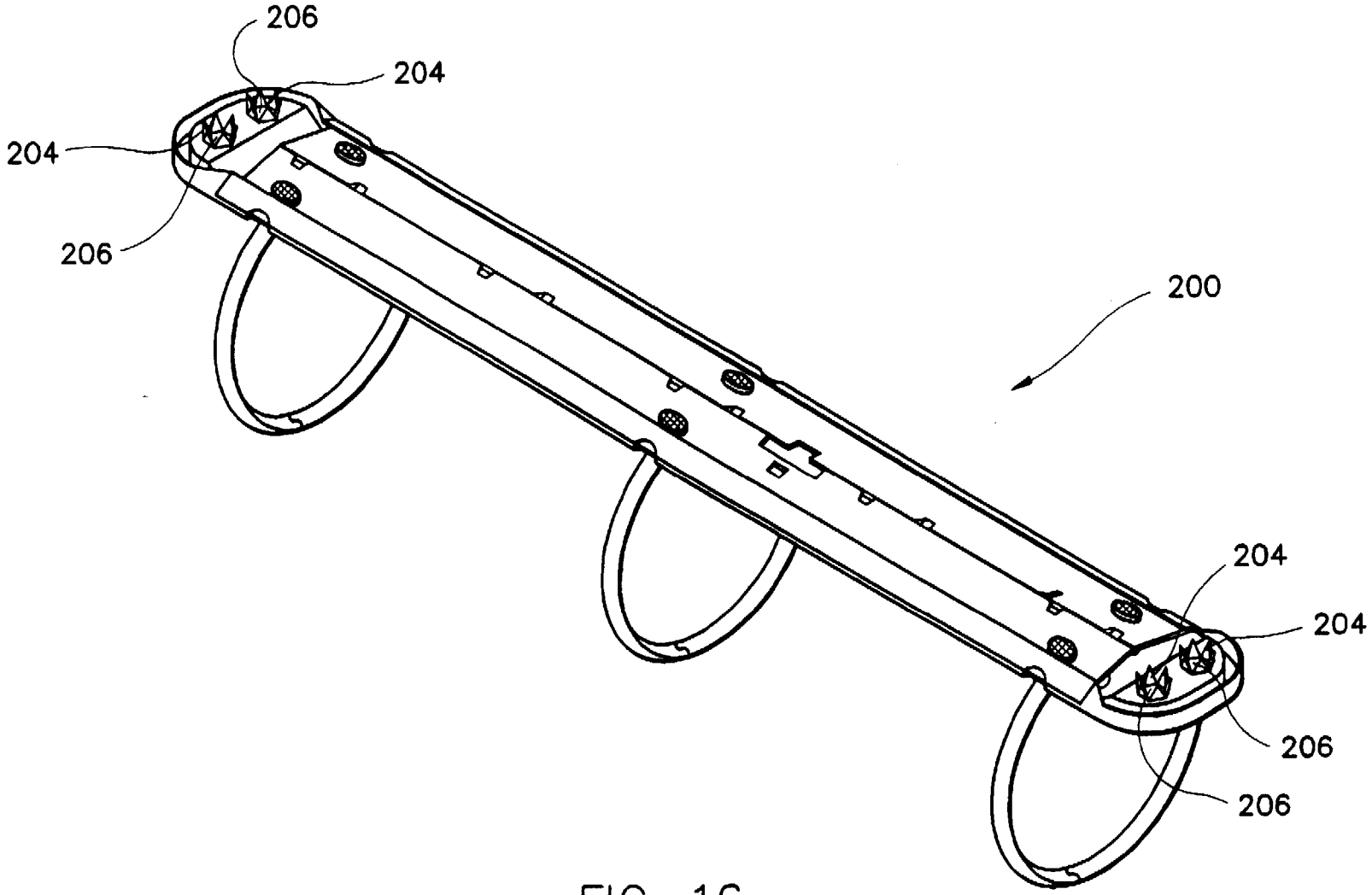
FIG. 16 shows a bottom perspective view of the ring binder shown in FIG. 15.

FIGS. 15 and 16 show a third embodiment of a ring binder according to the present invention generally designated as 200. The major difference of this embodiment from the first embodiment discussed above is the provision of two securing members 202 at each end of the ring binder 200. Each securing member 202 includes six arcuate pointed sectors 204 downwardly depending from the periphery of an orifice 206. It is thus possible to secure the ring binder 200 to a cardboard/paperboard cover without using any rivet.

It should be noted that the above only illustrates embodiments and examples in which the invention may be carried out, and that further modifications and/or alterations may be made to the examples without departing from the spirit of the invention.

I claim:

1. A ring binder comprising a substantially rigid upper structure, a lower structure supported by said upper structure and at least two pairs of ring members mounted to said lower structure, said at least two pairs of ring members comprising a first type of ring member and a second type of ring member and said lower structure being pivotally movable between a first position in which said at least two pairs of ring members are closed and locked, and a second position in which said at least two pairs of ring members are open and unlocked, wherein when a force is applied to said first type of ring member of said at least two pairs of ring members, the ring binder is unlocked and the lower structure is movable from the first position to the second position in order to open all said pairs of ring members, and wherein when a force is applied to said second type of ring member of said at least two pairs of ring members, the lower structure is locked against movement from the first position to the second position.

2. A ring binder according to claim 1 further characterized in that when force is applied on any of the pairs of ring members, the ring binder is movable from the second position to the first position in order to close and lock the pairs of ring members.

3. A ring binder according to claim 1 further characterized in that the binder comprises lock means movable between a locked position in which the lower structure is locked against movement from the first position to the second position, and an unlocked position in which the lower structure is movable from the first position to the second position.

4. A ring binder according to claim 1 further characterized in that the lock means comprises at least one lock member which, when the lock means is in its locked position, engages the lower structure against pivotal movement.

5. A ring binder according to claim 4 further characterized in that the lock means comprises two lock members.

6. A ring binder according to claim 4 further characterized in that the at least one lock member, in its locked position, engages an upper surface of the lower structure.

7. A ring binder according to claim 4 further characterized in that the lower structure comprises stopping means against which the at least one lock member engages when the lock means is in its locked position.

8. A ring binder according to claim 4 further characterized in that the lower structure comprises aperture means for receiving at least part of the at least one lock member when the lower structure moves from its first position to its second position.

9. A ring binder according to claim 3 further characterized in that the lock means comprises a key member operable to move the lock means from the locked position to the unlocked position.

10. A ring binder according to claim 9, further characterized in that the lock member in its locked position, engages an upper surface of the lower structure and the key member is operable to disengage the at least one lock member from the lower structure.

11. A ring binder according to claim 9 further characterized in that the lock member in its locked position, engages an upper surface of the lower structure and the key member is operable to disengage the at least one lock member from the upper surface of the lower structure.

12. A ring binder according to claim 7 further characterized in that the lock means comprises a key member operable to move the lock means from the locked position to the unlocked position and the key member is operable to disengage the at least one lock member from the stopping means.

13. A ring binder according to claim 9 further characterized in that the key member is fixedly engaged with the at least one lock member for simultaneous movement.

14. A ring binder according to claim 13 further characterized in that the key member comprises a sloped portion upon which the lower structure acts when the lower structure moves from its first position to its second position.

15. A ring binder according to claim 14 further characterized in that when the sloped position of the key member is acted upon by the lower structure, the at least one lock member is movable from its locked position to its unlocked position.

16. A ring binder according to claim 9 further characterized in that the lower structure comprises hole means for receiving at least part of the key member when the lower structure moves from its first position to its second position.

17. A ring binder according to claim 9 further characterized in that the key member comprises a wire element.

18. A ring binder according to claim 3 further characterized in that the lock means is engaged with the upper structure.

19. A ring binder according to claim 3 further characterized in that the lock means is swivellably movable relative the upper structure.

20. A ring binder according to claim 19 further characterized in that the lock means is supported for swivelling movement by support means.

21. A ring binder according to claim 20 further characterized in that the support means comprises at least one inturned part of the upper structure.

22. A ring binder according to claim 9 further characterized in that the key member is adjacent said first type of ring members.

23. A ring binder according to claim 7 further characterized in that the binder comprises securing means adapted to secure the ring binder to an base member.

24. A ring binder according to claim 23 further characterized in that the securing means is integrally formed with the upper structure.

* * * * *